US005109934A

United States Patent [19]

Mochizuki

[11] Patent Number: 5,109,934

[45] Date of Patent: May 5, 1992

[54] MOBILE DRILLING RIG FOR CLOSELY SPACED WELL CENTERS

[75] Inventor: David A. Mochizuki, Anchorage, Ala.

[73] Assignee: Nabors Industries, Inc., Houston, Tex.

[21] Appl. No.: 654,754

[22] Filed: Feb. 13, 1991

[51] Int. Cl.[5] ..... E21B 7/02

[52] U.S. Cl. ..... 175/170; 175/207; 175/219; 175/85; 173/184

[58] Field of Search ..... 175/85, 24, 52, 207, 175/219; 173/22, 23, 28, 163; 166/77.5, 78

[56] References Cited

U.S. PATENT DOCUMENTS 3,650,339 3/1972 Selfe et al. ..... 175/85

4,547,109 10/1985 Young et al. ..... 175/85 X 4,899,832 2/1990 Bierschied, Jr. ..... 173/23

*Primary Examiner*—Stephen J. Novosad

*Attorney, Agent, or Firm*—Arnold, White & Durkee

[57] ABSTRACT

A modular drilling apparatus having three units, each of which is fully enclosed, transportable and positionable for workover and completion of wells on 30 foot well centers without interfering with the operation of adjacent wells. The first end of the drilling unit is positioned over a well with its central axis diagonal to the centerline of the wells and at a right angle to the pipe handler in the pipe shelter unit, the vertex of the right angle being at the well center. The mud unit is set back from the centerline of the wells, and is functionally connected to the second end of the drilling unit. The width of the drilling unit is greater than 50% of the clearance between adjacent well houses on each side of the well.

10 Claims, 2 Drawing Sheets

MOBILE DRILLING RIG FOR CLOSELY SPACED WELL CENTERS

RELATED APPLICATIONS

This application is related to the following copending applications of David Alan Mochizuki: Ser. No. 07/654,237, filed Feb. 12, 1991, now U.S. Pat. No. 5,072,656; Ser. No. 07/654,989, filed Feb. 13, 1991; Ser. No. 07/654,775, filed Feb. 13, 1991; and Ser. No. 07/655,562, filed Feb. 13, 1991.

BACKGROUND OF THE INVENTION

1. Field Invention

This invention relates generally to mobile oil well drilling equipment. More specifically, this invention is related to mobile, self-propelled, workover and completion rigs that are particularly useful for closely spaced wells.

2. Descriotion Of The Related Art

Mobile oil well drilling equipment has been in existence for many years, and facilitates the rig being moved to a well site in a partially assembled state. The mobile rig includes a mast which is folded down and transported on a powered carrier on wheels. At the well site, the rig is erected, for example, with the use of a telescoping mast. A number of supports are extended from the carrier to the ground to support the rig and pipe suspended or hung on the rig. Other components of the rig include pipe handling equipment, power generation equipment and mud equipment, all of which are transported and positioned in close proximity to the drilling rig. An example of a mobile drilling rig is shown in U.S. Pat. No. 4,899,832.

For drilling operations in arctic locations (for example, on the North Slope of Alaska) it is desirable that the drilling rig itself and various components of drilling equipment be maintained in a heated enclosure, as much as possible, for protection of equipment and personnel working on the rig. In arctic conditions, it is critical that equipment and personnel be shielded from sub-zero temperatures, snow and ice that impairs drilling work. The equipment which must be protected includes the drilling rig itself, the mud equipment, and pipe storage and handling equipment. The mud equipment includes all devices for mixing and controlling mud flow to the rig. For pipe storage and pipe handling, it is necessary to warm, clean and store several thousands of feet of pipe, in 30 to 45 foot lengths prior to conveying the pipe to the mast on the drilling rig.

Environmental sensitivity is another concern at arctic locations such as oil fields on the North Slope of Alaska. It is critical that wells and mobile equipment be installed and operated to minimize any danger or risk to the environment.

Typically, it is necessary to drill several thousand feet into permafrost. To protect the permafrost and surrounding tundra from melting, a five foot deep gravel pad is laid out on top of the tundra. The gravel pad provides an insulating surface above the permafrost or tundra, and the pad provides a surface on which the mobile drilling equipment travels. The gravel pad provides a stable surface for the rig over the permafrost or tundra when the surrounding permafrost thaws. The gravel serves as an insulating layer over the permafrost. Each gravel pad accommodates several dozen wells, and is on the order of one half mile in length and width. The wells, drilling equipment, sump areas, and other equipment are located on the gravel pad. A flow line or series of flow lines extends from each well to a sump or reserve pit. Typically, clusters of wells are located along one or more centerlines on the gravel pad. For example, each well center may be located approximately one hundred feet from the adjacent well center. The 100 foot distance between the well centers was considered to be necessary to prevent the radiant heat from each well from thawing the permafrost. In recent years, however, it has been found that wells may be positioned on well centers closer than 100 feet without the radiant heat problem.

In an effort to minimize environmental impact on tundra and wildlife, additional wells are drilled on existing gravel pads between wells previously in existence, rather than building additional sites. With these additional wells, ultimately each well is closely spaced to the adjacent wells. For example, each well center may be less than fifty feet from the adjacent well eenter, and in some cases as close as ten feet. The operating space is further restricted because each well is enclosed in a well house. Typically, the well house base is sixteen feet by fourteen feet, with a height of eighteen feet. The present invention is particularly useful for workover and completion of well centers that are as close as thirty feet.

The close proximity of each well to adjacent wells presents a problem for mobile workover and completion rigs. A mobile rig must be maneuvered into position and operated without interfering with adjacent wells. It is extremely undesirable to shut in the adjacent wells. Another limitation on the maneuvering and operating space for the rig is the flow line between each well and the sump or reserve pit. It is not possible to position the rig on the flow line side of the wells.

In the past, the problem of workover and completion of closely spaced well centers has been addressed by two alternative approaches: (a) individualized set-up and assembly of components in the space available at each well, or (b) cantilever rig design requiring significantly strengthened structural reinforcement.

Alternative (a) is undesirable because the equipment must be set up in a specific arrangement at each well, then disassembled, at considerable time and expense. Therefore, alternative (a) is a particular problem for workover and completion under arctic conditions.

Alternative (b), cantilever rigs, may be used for workover and completion of wells on as close as ten foot well centers. Cantilever rigs are designed to back up at a 90 degree angle to the line of wells, and have a U-shape to position the rig over the top of the well. However, cantilever rigs require significantly strengthened structural reinforcement at greatly added expense over other types of rigs. The structural reinforcement is required because a mast bearing 500,000 pounds or more of load must be cantilevered over the well center, rather than supported on the ground.

A general object of the present invention is to provide a non-cantilevered configuration of mobile drilling apparatus that may be used in arctic conditions on wells having closely spaced well centers.

Another object of the present invention is to provide a new and improved method and apparatus for positioning a mobile workover and completion rig between adjacent well houses.

A further object of the present invention is to provide a highly portable enclosed workover and completion rig.

Another object of the present invention is to provide a mobile rig and method which eliminates the need to shut down adjacent wells during workover and completion operations.

Another object of the present invention is to provide a new and improved modular configuration for mobile oil well workover and completion equipment capable of working between adjacent wells having thirty foot well centers.

SUMMARY OF THE INVENTION

The present invention provides a mobile workover and completion rig for well centers as close as thirty feet. The rig comprises three separate transportable modules, each of which is fully enclosed by wall panels. The drilling module supports the mast, and houses the rotary table, draw works, and one or more engines. The pipe shelter module houses lengths of pipe on pipe racks, and a pipe handler that conveys pipe to the first module, then up the mast of the rig. The drilling mud module houses boilers, generator, fuel and water tanks, pump room, and mud tank. The mud module also includes a mud elevator and mud mixing device for mixing drilling mud before it is pumped into the drill string.

According to the present invention, the first end of the drilling module is positioned over the well center on an axis that is diagonal to the centerline of the wells. The drilling module and pipe shelter module form a right angle with the vertex of the right angle intersecting the centerline of wells. The mud module is set back from the centerline of wells and is positioned parallel to and adjoining the second end of the drilling module, such that access to the mud elevator is not restricted. The width of the first module is greater than 50% of the distance between each of the adjacent well houses.

DETAILED DESCRIPTION OF A PREFERRED EMBODIMENT

Figure 1A:
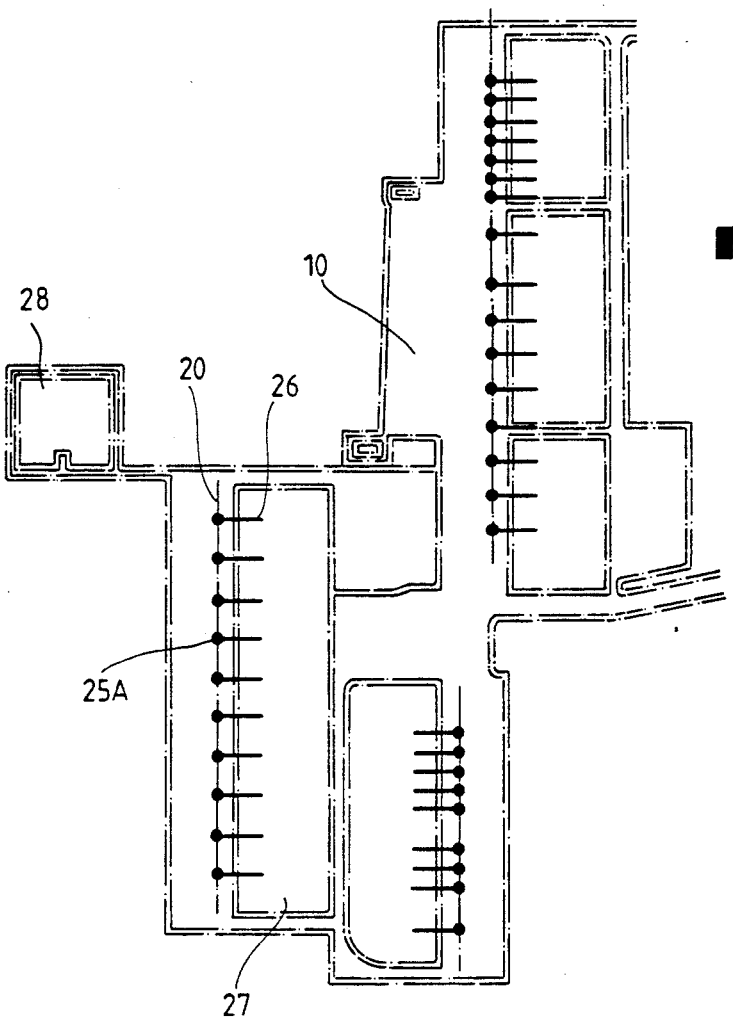
FIG. 1A and 1B are overhead views of a typical drill site for application of the present invention.
Figure 1B:
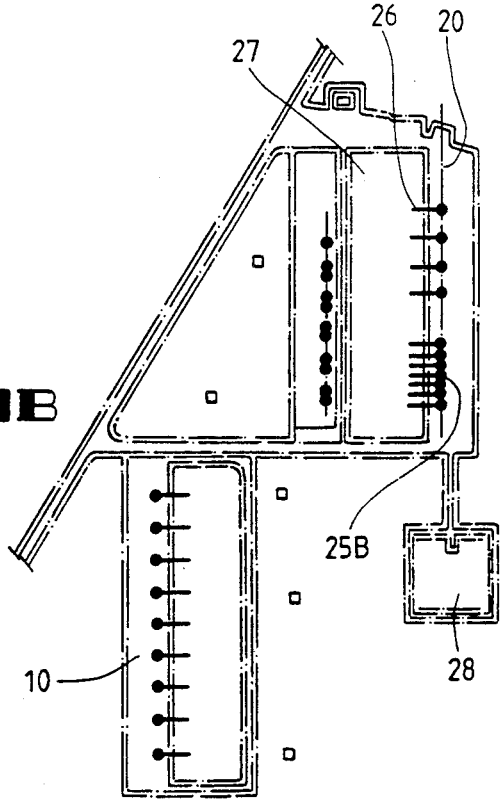

FIG. 1A and 1B are overhead views of typical drill sites which show how the present invention is used. A gravel pad 10 is spread across the permafrost or tundra in the desired configuration. A centerline 20 for each cluster of oil wells is laid out across the gravel pad. As shown in FIG. 1A, well centers 25A are typically positioned at intervals of 100 feet, for example. A flow line or flow line connection 26 extends between each well center 25A and a sump or reserve pit 27. Also shown is a flare pit 28.

Now referring to FIG. 1B, well centers 25B are positioned at closely spaced intervals, for example 30 feet from each adjacent well center. The present invention is particularly useful for workover and completion work on closely spaced well centers.

Figure 2:
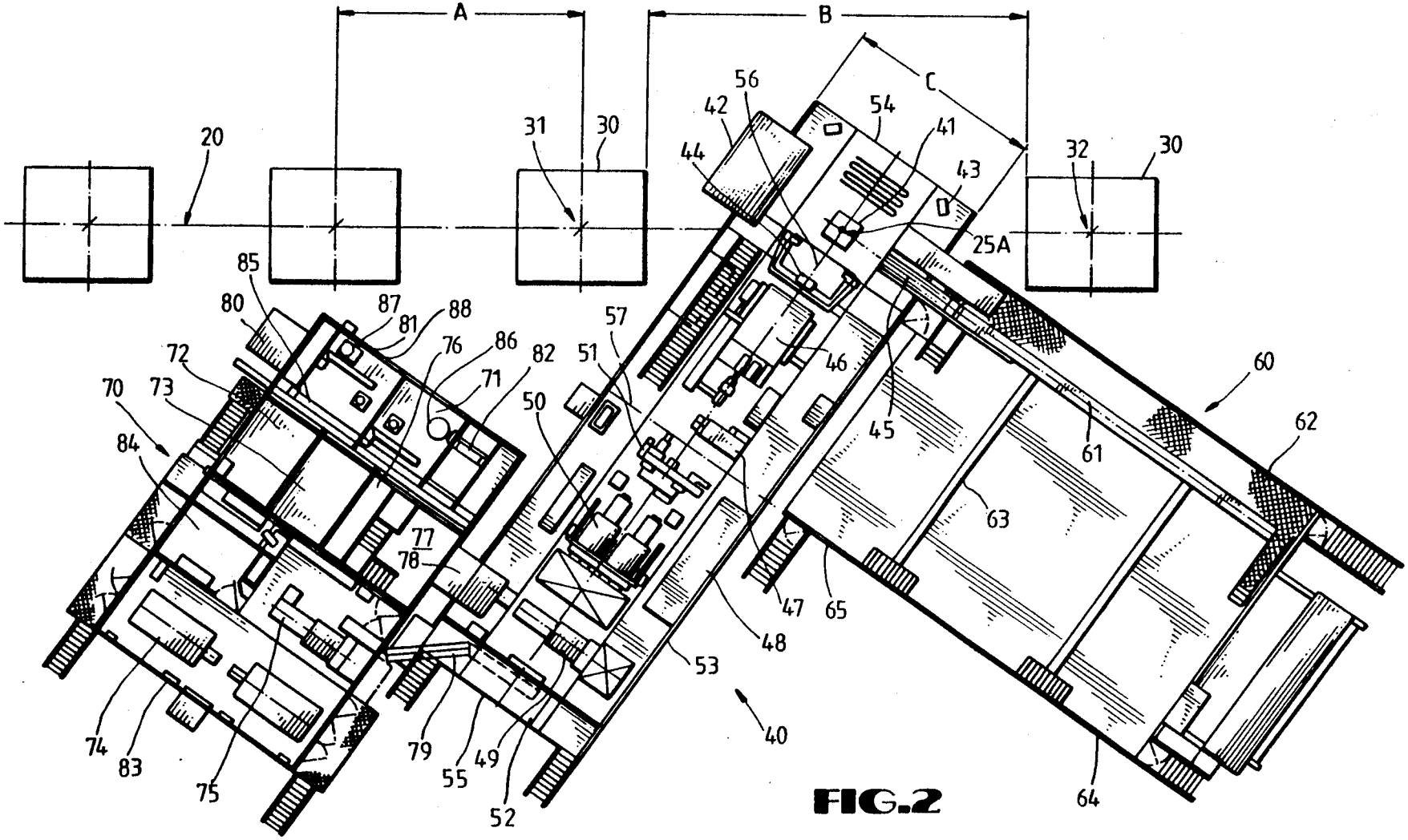
FIG. 2 is an overhead cutaway view of the apparatus according to a preferred embodiment of the present invention.

As shown in FIG. 2, the present invention comprises three modules: a drilling module 40, a pipe shelter module 60, and a drilling mud module 70. These three units are interconnected and positioned to operate on well center 25B along centerline 20 between adjacent wells having well centers 31 and 32. Each of the adjacent wells is enclosed in a well house 30. The well house typically has dimensions of 16 feet by 14 feet, with a height of 18 feet.

In the well configuration shown in FIG. 2, the distance A between each well center is 30 feet. The operating area between the well centers is further restricted by the well houses 30. In this example, the operating area B between the adjacent well houses on each side of the well is 46 feet (a total of 60 feet between well centers 30 and 31, minus 16 feet for the two well houses).

The drilling mast is mounted on the drilling module 40, which is a self-propelled carrier with jacking and support systems (not shown). The pipe shelter module 60 and mud module 70 are fitted with trailer wheel assemblies with integral hydraulic jacking systems (not shown). The pipe shelter module and the mud module are moved by oilfield trucks or tractors. Thus, the workover and completion apparatus of the present invention is unitized into one self-propelled and two trailerized modules.

The drilling module 40 is fully enclosed in wall panels 52. In a preferred embodiment, the drilling module is 24 feet in width and 83 feet in length. These dimensions are dictated by the arrangement of equipment in module 40, as shown in FIG. 2. The first end 54 is positioned over the well center 25A. The second end 55 of the drilling module includes an enclosed cab 52 for driving the module. The drilling module is self-powered and moves on wheels (not shown). Within the drilling module is a rotary device 4 that is positioned directly over the well center 25A for turning the pipe. The drilling module includes one or more diesel engines 50 coupled to a generator 49, accumulator 48, torque converter 51, mud pump 47, and draw works 46. The drill floor is equipped with a power swivel, at least two hydraulic winches 43, and a rotary table 41. The drilling module supports the mast (not shown) which is pivoted from a horizontal transport position to a vertioal drilling position. The equipment in the drilling module also includes dog house 42 and rotary chain case 44. The drilling module includes retractable base means and support jacks for supporting the first end and second end of the rig in engagement with the ground, so the rig is capable of supporting several hundred thousand pounds of load. The drilling module has a central axis (shown as the dashed line 56, also referred to as the major axis), and a minor axis (shown as dashed line 57).

The pipe shelter module 60 is fully enclosed with side walls 65 and is a movable trailer with oilfield trucks. The pipe shelter module 60 is positioned adjacent to and at a right angle to the central axis 56 of drilling module 40. The vertex of the right angle formed between the pipe handler 61 and the central axis 56 of the drilling module is at well center 25A. By positioning the pipe shelter module 60 perpendicular to the axis of the drilling module 40, interference with adjacent wells 32 and well houses is avoided. Drill pipe or tubing is conveyed on pipe handler 61 at an incline up to the pipe ramp 45 extending from the drilling module, and then raised vertically and suspended or hung by hook and block on the mast as needed. The pipe shelter module is capable of handling, cleaning and storing at least 10,000 feet of 5½ inch tubing. Within the pipe shelter module, drill pipe or tubing is handled and stored on pipe racks 63, and is transported in and out of the pipe shelter through door 64. One side of the pipe shelter module includes a walkway 62.

The mud module 70 is enclosed within wall panels 81. The first end 88 of the mud module is closest to the well center 25B, but is set back from the well centerline 20, as will be discussed below. The mud module 70 includes mud tank 71, fuel tank 72, water tank 73 and one or more boilers 74. Also in the mud module is generator 75 which is electrically connected to the drilling module via conduit 79. The mud module also includes a boiler feed tank 76, a water and fuel pump room 77, a shale shaker 82, a control panel 83, a workshop and tool area 84, a mud conveyor 85, degasser 86, and a mud mixer 87. Also shown is a passage 78 between the mud module and the drilling module 40. Drilling mud in sacks is transported by forklift or truck to mud elevator 80 adjacent the first end 88 of the mud module. The mud elevator raises the mud to the floor of the mud module. The mud is then mixed with fluid in mud mixer 87 and pumped out by a high pressure mud pump 47 up to the mast and into the drill string. To provide access to the mud elevator 80 and avoid interference with the adjacent well house, mud module 70 is set back from the well centerline 20. In this configuration, the mud module is positioned adjacent the drilling module, the first end 88 of the mud module positioned between the minor axis 57 and the second end 55 of the drilling module.

According to the present invention, the workover and completion rig is unitized into three modules: a self-propelled drilling module, a trailerized mud module moved by an oilfield truck or tractor, and a trailerized pipe shelter module moved by an oilfield truck or tractor. One advantage of unitizing the rig in only three modules is a reduction of the time for moving the rig from well to well to only a few hours. The present invention provides a highly efficient method and apparatus for workover and completion of existing wells on closely spaced well centers.

One feature of the present invention is the relationship between the width C of the drilling module 40 and the distance B between adjacent well houses 31 and 32. In the preferred embodiment, the ratio of C to B is greater than 50%. The width of the drilling module is 24 feet, and the distance between the adjacent well houses is 46 feet.

Another feature of the present invention is the configuration of the drilling module and pipe shelter. The central axis 56 of the drilling module is at an acute angle to the centerline 20 of the wells. The vertex of the angle between the central axis 56 of drilling module 40 and the pipe handler 61 is at well center 25B. The advantage of this configuration is that it facilitates the rig being used between pipe shelters on adjacent wells having well centers as close as 30 feet.

Another feature of the present invention is the configuration of mud module 70 adjacent the second end 55 of the drilling module 40. The first end 88 of the mud module is positioned between the minor axis 57 and the second end 55 of the drilling module. This configuration facilitates functional interconnection of mud equipment between the mud module and mast, but the mud module is set back from the centerline of the wells. This configuration also facilitates pumping mud up to the drill string without restricting access to mud elevator 80 and without interfering with operation of adjacent wells.

Although variations in the embodiment of the present invention may not each realize all of the advantages of the invention, certain features may become more important than others in various applications of the device. The invention, accordingly, should be understood to be limited only by the scope of the appended claims.

What is claimed is:

1. An enclosed modular drilling apparatus comprising:

(a) a first self-propelled carrier having a first end, second end, major axis and minor axis, the first end positionable over a well, the carrier supporting a mast, drill pipe, power supply, and power delivery means for delivering torque from the powe supply to the drill pipe;

(b) a second trailer-mounted carrier adapted to store pipe and having pipe conveyor means interconnectable with the first carrier for delivering pipe to the first carrier; and (c) a third trailer-mounted carrier having drilling mud delivery means interconnectable with the first carrier for delivering drilling mud to the first carrier, the third carrier positionable adjacent the second end of the first carrier rearwardly of the minor axis of the first carrier.

2. The enclosed modular drilling apparatus of claim wherein the first self-propelled carrier is positionable over a well between two well houses; the width of the first carrier being greater than 50% of the distance between the two well houses.

3. The enclosed modular drilling apparatus of claim 1 wherein the first self-propelled carrier has a central axis positionable over a well center between adjacent well centers and intersecting the centerline between the well centers, and the second trailer-mounted carrier is positionable substantially perpendicular to the central axis of the first carrier, the central axis of the first carrier and the second carrier being at an acute angle to the centerline.

4. A modular drilling apparatus comprising:

(a) a portable enclosed drilling module for supporting a mast in an upright position over a well between two adjacent wells, the drilling module having side walls, end walls, and a longitudinal axis extending from a first end to a second end thereof, the drilling module enclosing a rotary device over the well adjacent the first end, the drilling module having retractable support means for engagement with the ground, and having a cab at the second end for driving the drilling module;

(b) a portable enclosed pipe shelter module having side walls, end walls, and a longitudinal axis extending from a first end to a second end thereof, one side of the pipe shelter module having pipe conveying means for conveying pipe to the drilling module, the first end of the pipe shelter module positionable adjacent the first end of the drilling module such that the longitudinal axes of the pipe conveying means and the drilling module are perpendicular; and (c) a portable enclosed mud module having side walls, end walls, and a longitudinal axis extending from a first end to a second end thereof, the first end of the mud module positionable adjacent the second end of the drilling module such that the longitudinal axis of the mud module and drilling module are parallel; the mud module having means for conveying mud to the drilling module.

5. The modular drilling apparatus of claim 4 wherein the first end of the drilling module is positionable directly over a second well center on a centerline between first and third well centers, with the longitudinal axis of the drilling module at an acute angle to the centerline.

6. The modular drilling apparatus of claim 4 wherein the drilling module further comprises an engine, a power generator, and power delivery means.

7. The mobile drilling rig of claim 4 wherein the mud module further comprises a boiler, a mud mixer, and mud elevator.

8. A modular oil well workover and completion apparatus having three separately transportable and connectable units adapted to work on a first well in a cluster of wells on 30 foot well centers along a centerline without interfering with operation of adjacent wells and comprising:

(a) an enclosed driveable drilling unit having an elongated central axis, a first end and a second end, the first end having: retractable support means for engagement with the ground, a rotary device positionable over the well center of the first well, an elongated mast adapted to be pivoted from a horizontal transport position to a vertical drilling position, power generating means, a drive unit connected to the power generating means for imparting rotary motion to the rotary device, pipe raising means adapted to convey pipe upwardly on the mast, and mud pumping means for pumping mud at an incline to the mast;

(b) an enclosed transportable pipe shelter unit having a first end, a second end. pipe storage means, pipe cleaning means, pipe handling means on one side of the pipe shelter unit adapted to convey pipe at an incline out the first end, the first end of the pipe shelter unit positionable adjacent the first end of the drilling unit, whereby the pipe handling means is linked to the pipe raising means, and wherein the pipe handling means is at a right angle to the central axis of the drilling unit with the vertex of the right angle positioned substantially over the well center; and (c) an enclosed transportable drilling mud unit having a first end, a second end, at least one boiler, mud mixing and storage means, a mud elevator, the first end of the drilling mud unit positionable adjacent the second end of the drilling unit and linked to the drilling unit by a separate passage and electrical conduit.

9. The modular oil well workover and completion apparatus of claim 8 wherein the drilling unit is positionable at an acute angle to the centerline of the wells.

10. The modular oil well workover and completion apparatus of claim 8 wherein the drilling mud unit is set back from the centerline of the wells.

* * * * *

UNITED STATES PATENT AND TRADEMARK OFFICE

CERTIFICATE OF CORRECTION

PATENT NO. : 5,109,934

DATED : May 5, 1992

INVENTOR(S) : David A. Mochizuki

It is certified that error appears in the above-indentified patent and that said Letters Patent is hereby corrected as shown below:

Column No. 1 Line No. 9
Change 07/654,989 to 07/654,898

Column No. 1 Line No. 14
Change Field Invention to Field Of The Invention

Column No. 1 Line No. 20
Change Descriotion to Description

Column No. 1 Line No. 39
Change possible. for to possible, for

UNITED STATES PATENT AND TRADEMARK OFFICE

CERTIFICATE OF CORRECTION

PATENT NO. : 5,109,934

DATED : May 5, 1992

INVENTOR(S) : David A. Mochizuki

It is certified that error appears in the above-indentified patent and that said Letters Patent is hereby corrected as shown below:

Column No. 4 Line No. 29
Change rotary device 4 to rotary device 41

Column No. 4 Line No. 37
Change vertioal to vertical

Column No. 6 Line No. 7
Change powe supply to power supply

Column No. 6 Line No. 19
Change apparatus of claim to apparatus of claim 1

Signed and Sealed this

First Day of March, 1994

Bruce Lehman

*Attest:*

BRUCE LEHMAN

*Attesting Officer*

*Commissioner of Patents and Trademarks*